US010184231B2

(12) United States Patent
Pitsch et al.

(10) Patent No.: US 10,184,231 B2
(45) Date of Patent: Jan. 22, 2019

(54) PULL-OUT FAUCET HOSE RETRACTION SYSTEM AND METHOD

(71) Applicant: AS IP Holdco, LLC, Piscataway, NJ (US)

(72) Inventors: Walter Pitsch, Washington, NJ (US); Hsiao Chang Li, Edison, NJ (US)

(73) Assignee: AS IP Holdco, LLC, Piscataway, NJ (US)

( * ) Notice: Subject to any disclaimer, the term of this patent is extended or adjusted under 35 U.S.C. 154(b) by 14 days.

(21) Appl. No.: 15/270,329

(22) Filed: Sep. 20, 2016

(65) Prior Publication Data

US 2017/0096801 A1 Apr. 6, 2017

Related U.S. Application Data

(60) Provisional application No. 62/235,743, filed on Oct. 1, 2015.

(51) Int. Cl.
*E03C 1/04* (2006.01)
*E03C 1/02* (2006.01)

(52) U.S. Cl.
CPC ..... *E03C 1/0404* (2013.01); *E03C 1/025* (2013.01); *E03C 1/0401* (2013.01); *E03C 1/0408* (2013.01); *E03C 2001/0415* (2013.01); *E03C 2001/0417* (2013.01)

(58) Field of Classification Search
CPC ..... E03C 2001/0415; E03C 2001/0417; E03C 1/025; E03C 1/0401; E03C 1/0404; E03C 1/0408; A61H 33/6031; Y10T 137/6943
USPC ..... 137/355.2, 355.23, 801; 239/195–198
See application file for complete search history.

(56) References Cited

U.S. PATENT DOCUMENTS

| | | | | |
|---|---|---|---|---|
| 1,202,718 A | | 10/1916 | Holmes | |
| 3,666,220 A | | 5/1972 | Rider | |
| 3,889,896 A | * | 6/1975 | O'Hara | B65H 75/36 137/355.23 |
| 4,151,648 A | | 5/1979 | Hirth | |
| 4,446,884 A | * | 5/1984 | Rader, Jr. | B65H 75/38 137/355.23 |
| 5,027,450 A | * | 7/1991 | Lang | A61H 33/6031 239/197 |
| 5,093,942 A | * | 3/1992 | Lang | A61H 33/6036 239/197 |
| 5,277,454 A | * | 1/1994 | Lorch | E03C 1/0401 239/587.1 |

(Continued)

FOREIGN PATENT DOCUMENTS

| | | | | |
|---|---|---|---|---|
| DE | 918080 C | * | 9/1954 | E03C 1/06 |
| EP | 1201836 A2 | * | 5/2002 | E03C 1/0404 |

OTHER PUBLICATIONS

International Search Report Application No. PCT/US2016/52599, dated Dec. 9, 2016.

*Primary Examiner* — R. K. Arundale
*Assistant Examiner* — Jonathan Waddy
(74) *Attorney, Agent, or Firm* — Morrison & Foerster LLP

(57) ABSTRACT

A hose retraction system for a pull-out or pull-down faucet includes a support bracket configured to couple to a shank, a cylindrical housing mountable to the support bracket, and at least one constant force coil spring disposable in the cylindrical housing and configured to at least partially couple to a hose disposed in a faucet spout. The coil spring provides a recoil force sufficient to retract the hose when the hose is extended from the spout.

20 Claims, 12 Drawing Sheets

(56) References Cited

U.S. PATENT DOCUMENTS

| | | | | |
|---|---|---|---|---|
| 5,361,431 | A * | 11/1994 | Freier | E03C 1/0401 137/218 |
| 5,390,695 | A | 2/1995 | Howard | |
| 5,560,391 | A | 10/1996 | Bantaculo | |
| 5,893,528 | A | 4/1999 | Strokosz | |
| 6,250,338 | B1 | 6/2001 | Dempsey | |
| 6,588,444 | B2 | 7/2003 | Paplow et al. | |
| 6,659,124 | B2 * | 12/2003 | Burns | F16L 5/06 137/359 |
| 6,757,921 | B2 | 7/2004 | Esche | |
| 6,915,816 | B2 | 7/2005 | Nelson et al. | |
| 6,915,817 | B2 | 7/2005 | Benstead et al. | |
| 7,073,529 | B1 * | 7/2006 | Harkey | B65H 75/4402 137/355.23 |
| 7,162,782 | B1 * | 1/2007 | Nelson | E03C 1/0404 29/225 |
| 7,191,475 | B1 * | 3/2007 | Marcotte | E03C 1/0408 4/567 |
| 7,559,501 | B2 | 7/2009 | Jian | |
| 7,707,664 | B1 * | 5/2010 | Flynn | E03C 1/06 4/570 |
| 8,776,836 | B2 | 7/2014 | Ragner et al. | |
| 8,800,075 | B2 | 8/2014 | van Leyen et al. | |
| 9,840,831 | B1 * | 12/2017 | Esche | E03C 1/0404 |
| 10,072,402 | B2 * | 9/2018 | Esche | E03C 1/0404 |
| 2003/0098084 | A1 * | 5/2003 | Ragner | A47L 9/24 138/129 |
| 2004/0177880 | A1 * | 9/2004 | Nelson | E03C 1/04 137/355.23 |
| 2008/0196160 | A1 * | 8/2008 | Alder | E03C 1/0404 4/678 |
| 2009/0139583 | A1 | 6/2009 | Tannahill et al. | |
| 2010/0043135 | A1 * | 2/2010 | Patterson | E03C 1/06 4/612 |

* cited by examiner

FIG. 1
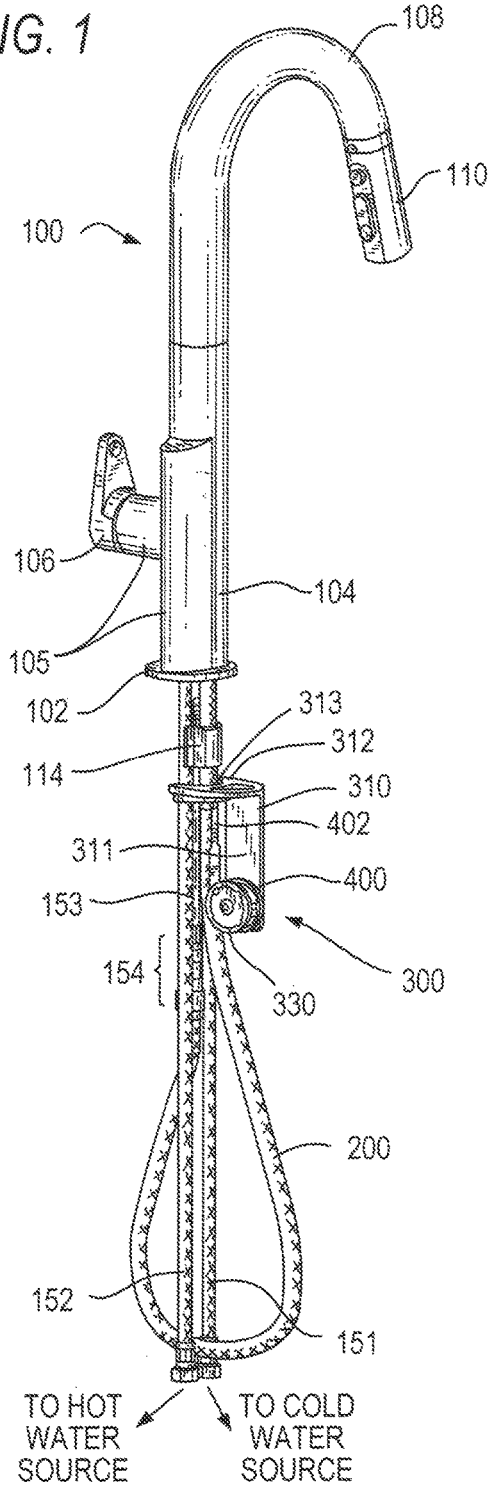
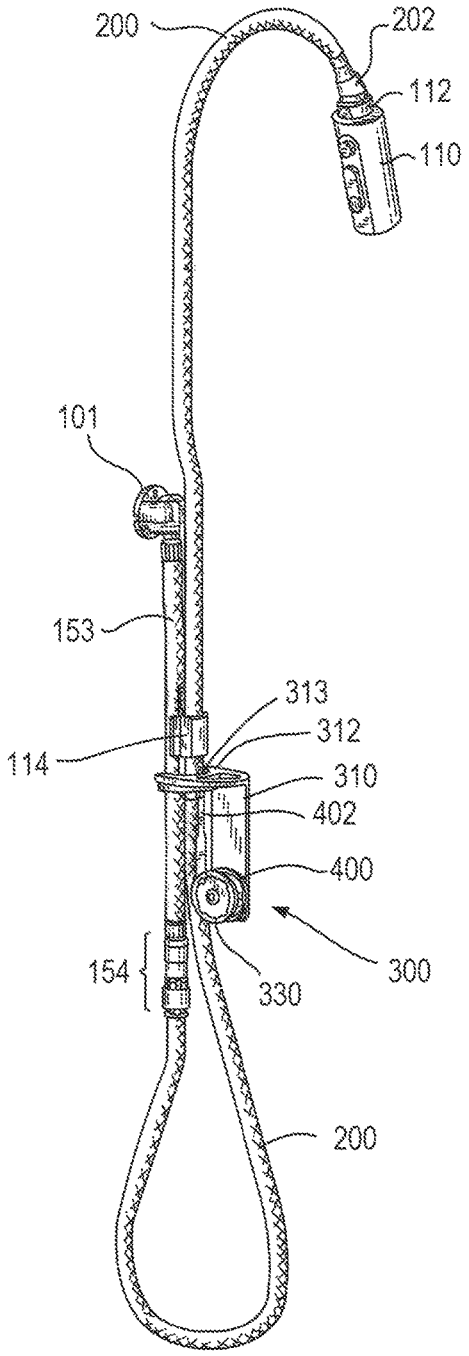
FIG. 2

PULL-OUT FAUCET HOSE RETRACTION SYSTEM AND METHOD

CROSS-REFERENCE TO RELATED PROVISIONAL APPLICATION

This application claims the benefit of U.S. Provisional Application No. 62/235,743, filed on Oct. 1, 2015, the disclosure of which is hereby incorporated by reference herein in its entirety.

COPYRIGHT NOTICE

Portions of the disclosure of this patent document contain materials that are subject to copyright protection. The copyright owner has no objection to the facsimile reproduction of the patent document or patent disclosure as it appears in the U.S. Patent and Trademark Office patent files or records solely for use in connection with consideration of the prosecution of this patent application, but otherwise reserves all copyright rights whatsoever.

FIELD OF THE INVENTION

The present invention generally relates to pull-out faucets.

BACKGROUND OF THE INVENTION

Faucets are ubiquitous plumbing products that serve the basic purpose of delivering hot, cold, or mixed water from a water supply to a user. Some faucets, especially kitchen faucets, feature pull-down or pull-out spray mechanisms, which provide users with more flexibility in directing water output. A traditional pull-out faucet typically employs a weight to retract the faucet spray hose after the spray head is released. However, the weight oftentimes fails to fully retract the hose and return the spray head to its docking position. Some faucets also utilize magnets (attached to the spray head and to the spout tube) that, combined with the weight on the hose, act to fully dock the spray head after use. However, depending on where the weight is mounted on the hose, any length of the hose beyond the mounting location cannot be pulled out of the faucet spout.

SUMMARY OF THE INVENTION

Generally speaking, it is an object of the present invention to provide embodiments of a new pull-out or pull-down faucet hose retraction system that avoids the disadvantages of conventional constructions.

According to an embodiment of the present invention, a pull-out or pull-down faucet hose retraction system includes one or more constant force coil springs disposed in a cylindrical housing to return the faucet spray head to its home docking position. The housing is mounted (e.g., on its side) onto a support bracket that is partially open. The bracket is fastened (e.g., via press-fit, clip-and-notch, male-to-female threaded coupling, or the like) to a shank, such as, for example, a fixation shank of the faucet.

In one embodiment, the coil spring has a narrow strip at one end. The narrow strip has a hole that interacts with an attachment member fixed to the hose to secure the coil spring to the hose. The narrow strip can, for example, be positioned against the hose, inserted into a crimp on the hose, and coupled, via the hole, to a hook on the crimp. The other end of the coil spring is then free to spin within the cylindrical housing during hose extension and retraction.

It should be understood that any number of coil springs can be used to retract the spray head hose. In one embodiment, two coil springs are disposed in the cylindrical housing and coupled to the hose, providing sufficient recoil force for retracting the hose.

The width of each coil spring is preferably narrow relative to the passage width of the faucet spout, such that it can slide therethrough unimpeded. The length of each coil spring is also defined such that it cannot be completely pulled out of the cylindrical housing during pull-out or pull-down of the spray head. For example, the coil spring is preferably long enough such that about eight to twelve inches remain in the cylindrical housing at maximum hose extension.

Still other objects and advantages of the present invention will in part be obvious and will in part be apparent from the disclosure.

The present invention accordingly comprises the features of construction, combinations of elements, and arrangement of parts, all as exemplified in the constructions herein set forth, and the scope of the invention will be indicated in the claims.

BRIEF DESCRIPTION OF THE DRAWINGS

The present invention is discussed in greater detail below with reference to exemplary embodiments illustrated in the accompanying drawings, in which:

FIG. 1 is a perspective view of a pull-out faucet equipped with a hose retraction system in accordance with an embodiment of the present invention;

FIG. 2 is a perspective view of a pull-out faucet spray hose coupled to the hose retraction system embodiment shown in FIG. 1;

DETAILED DESCRIPTION OF THE PREFERRED EMBODIMENTS

Figure 3:
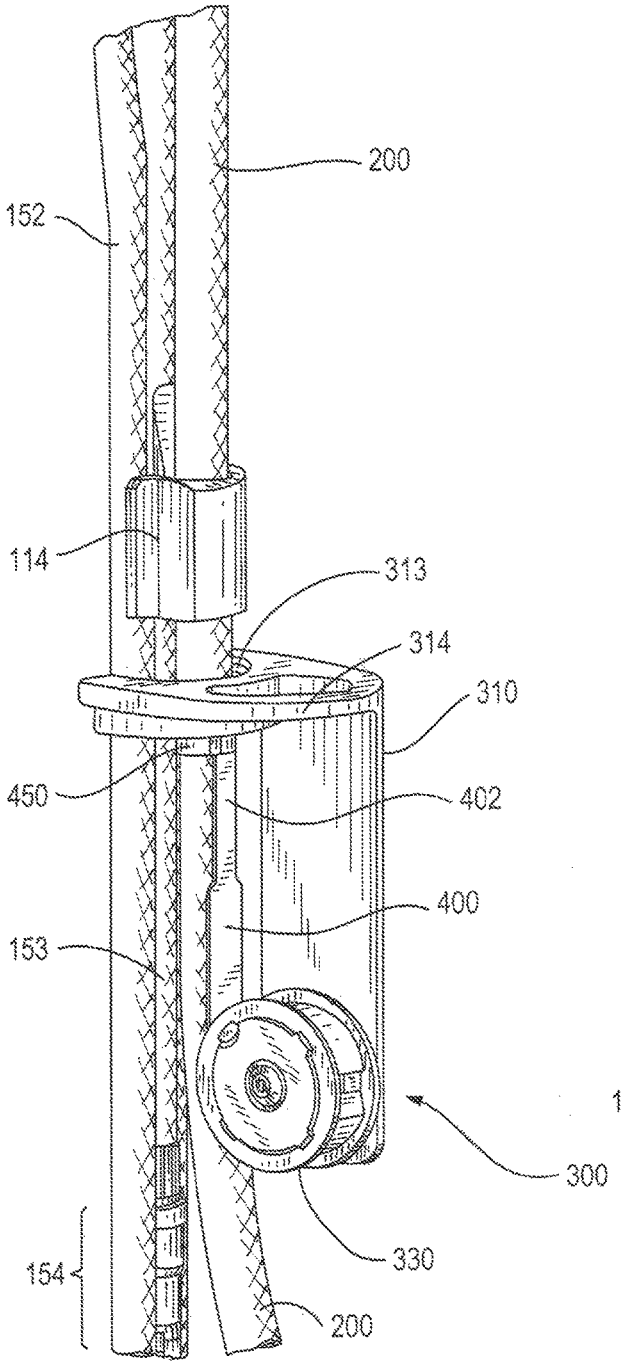
FIG. 3 is an enlarged view of the pull-out hose coupled to the hose retraction system embodiment shown in FIGS. 1 and 2.

FIG. 1 is a rear perspective view of a pull-out faucet 100 equipped with a hose retraction system 300 according to an embodiment of the present invention. FIG. 2 shows a pull-out hose 200 coupled to hose retraction system 300. Faucet 100 includes a base 102 that rests on a sink deck, a handle 106 for controlling water output, and a faucet body 104 disposed on the base and having a housing 105 that encloses a valve assembly 101 that interacts with handle 106. Faucet 100 also includes a spout 108 fluidly coupled to body 104, and a spray head 110 fluidly coupled to one end of pull-out hose 200. Pull-out hose 200 is at least partially disposed in spout 108, and includes, at one end, a bonnet 202 fluidly coupled to a hose coupling portion 112 of spray head 110. Valve assembly 101 is fluidly coupled to hot and cold water hoses 151 and 152 that lead to corresponding hot and cold water sources. Pull-out hose 200 is inserted in a through-hole of a hose divider guide 114, and slides freely therein during extension and retraction. Hot and cold water hoses 151 and 152 are also inserted into respective partially-open through-holes of divider guide 114. Frictional forces between these hoses and the corresponding through-holes serve to drive and secure hose divider guide 114 in or to a threaded shank below the sink deck. A mixed water hose 153 is fluidly coupled between valve assembly 101 and pull-out hose 200 for delivering water from valve assembly 101 into pull-out hose 200. Mixed water hose 153 is coupled to pull-out hose 200 via a connector assembly 154 consisting of one or more complementary threaded components.

Hose retraction system 300 includes a support bracket 310, a cylindrical housing 330, and a coil spring 400 disposed in cylindrical housing 330. Coil spring 400 can be composed of any suitable material that provides a constant recoil force (e.g., metal or the like), such that, when coil spring 400 is coupled to pull-out hose 200, an automatic return force acts on pull-out hose 200. Coil spring 400 is shown as having a uniform width throughout its length, except at one end 402 thereof, which is narrower than the remainder of the spring. End 402 is secured to a portion of pull-out hose 200 and provides a retraction force on hose 200 during hose extension. It should be understood that coil spring 400 can alternatively have a uniform width through its entire length, or other shape.

Support bracket 310 can be composed of any suitable material (e.g., metal, plastic, or the like), and includes a platform 312 having an opening, such as a partially-open loop 313, which engages a shank to hold the hose retraction system in place. Support bracket 310 also includes a handle 314 for generally maneuvering the support bracket (e.g., during removal of the bracket from and/or insertion of the bracket into the threaded shank). Cylindrical housing 330 is mounted, on its side, to a surface 311 of support bracket 310. Coil spring 400 is oriented in cylindrical housing 330 such that, when end 402 is coupled to pull-out hose 200, it passes through partially-open loop 313 during hose extension. Hot, cold, and mixed water hoses 151-153 are also routed through partially-open loop 313.

Figure 4:
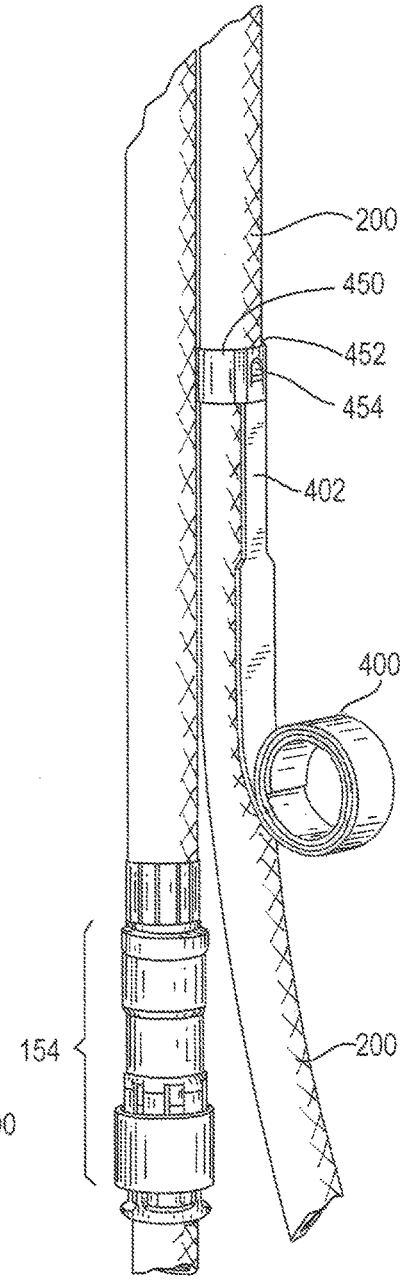
FIG. 4 is an enlarged view of a connection between the pull-out hose and coil spring of the hose retraction system embodiment shown in FIGS. 1-3.

FIG. 3 is an enlarged view of pull-out hose 200 and hose retraction system 300. FIG. 4 is an enlarged view of the connection between pull-out hose 200 and coil spring 400. The narrow end of coil spring 400 is secured to pull-out hose 200 via an attachment member 450. Attachment member 450 can be composed of any suitable material (e.g., metal, plastic, or the like) and can have a shape that at least partially conforms to the circumference of pull-out hose 200. In at least one embodiment, attachment member 450 can be a crimp or the like that is fixed to pull-out hose 200 (e.g., such that attachment member 450 is unable to slide about pull-out hose 200). Attachment member 450 can include a raised portion 452 having a hook member 454 that interacts with a hole 402*a* disposed at end 402 of coil spring 400. In this way, when end 402 is positioned against pull-out hose 200 and inserted under raised portion 452, hook member 454 can be inserted (e.g., press-fit) through and secured to hole 402*a*. Hook member 454 and hole 402*a* can be dimensioned such that the two can interact with one another to secure coil spring 400 to pull-out hose 200. With end 402 coupled to pull-out hose 200, the remainder of coil spring 400 is then free to spin within cylindrical housing 330 during hose extension and retraction.

According to at least one embodiment, the width of coil spring 400 is narrow relative to the passage width of spout 108, which allows spring 400 to unimpededly enter into spout 108 during hose extension. The length of each coil spring 400 is also defined such that spring 400 cannot be completely pulled out of cylindrical housing 330 during hose extension. For example, the length of coil spring 400 can be defined such that about eight to twelve inches thereof remain in cylindrical housing 330 at maximum hose extension.

Figure 6:
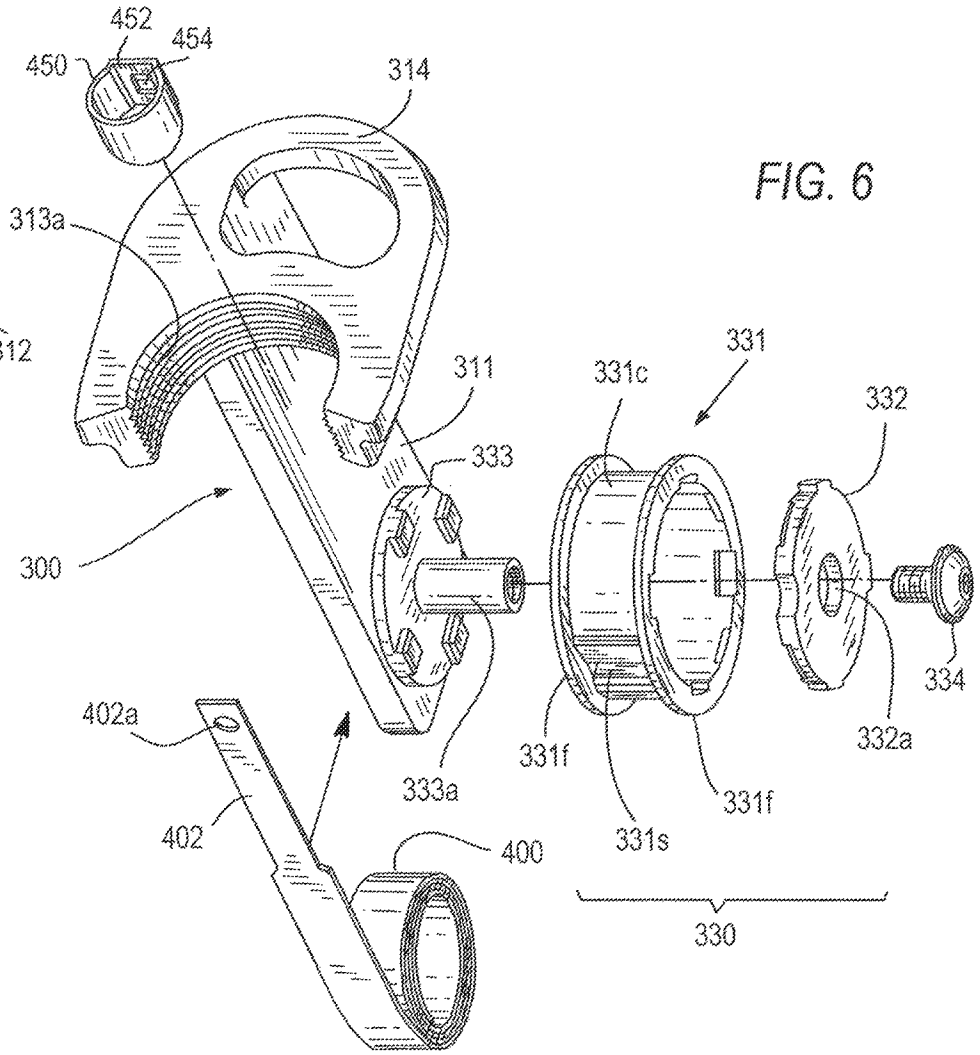
FIG. 6 is an exploded view of the hose retraction system in accordance with an embodiment of the present invention.
Figure 5:
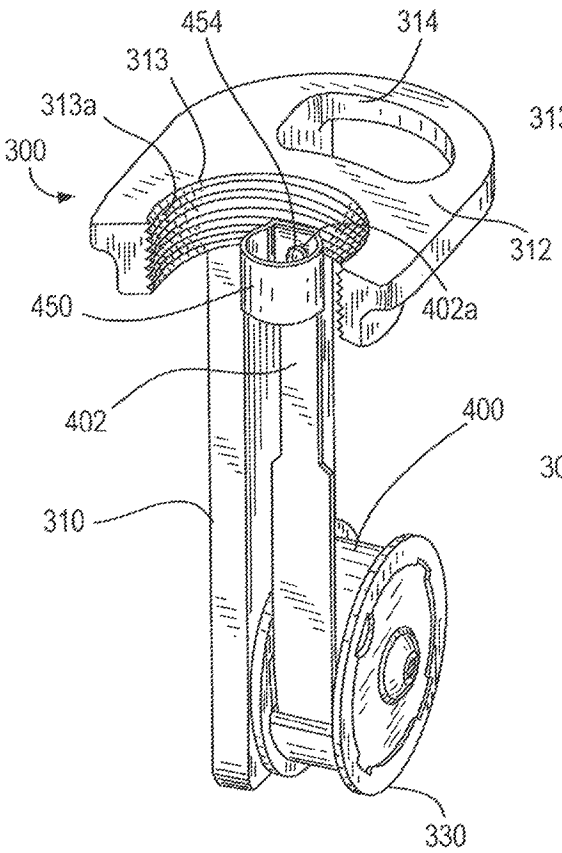
FIG. 5 is a perspective view of the hose retraction system embodiment shown in FIGS. 1-3.

FIG. 5 is an alternate view of hose retraction system 300. FIG. 6 is an exploded view of hose retraction system 300. As briefly described above, cylindrical housing 330 is mounted, on one side, to a surface 311 of the frame. The circumference of cylindrical housing 330 is larger than the circumference of coil spring 400 in its fully or partially coiled state, which allows coil spring 400 to be fully inserted therein and spin freely during hose extension and retraction. Cylindrical housing 330 includes a cylindrical container 331 that receives coil spring 400, and a cap 332 that closes one end of container 331. Container 331 includes flanges 331*f*, and a core 331*c* having one or more slots 331*s* through which end 402 and other portions of coil spring 400 can be inserted. A plate 333 can be coupled to or integrally formed on the surface (e.g., via injection molding) for mounting cylindrical container 331. Plate 333 can include a threaded coupler 333*a* that passes through container 331 and coil spring 400 and that interfaces with cap 332, when container 331, coil spring 400, and cap 332 are mounted onto the plate. Cap 332 has an aperture 332*a* defined to receive a screw 334, which can include complementary threads that couple to threaded coupler 333*a* to secure coil spring 400 within container 331.

Figure 9:
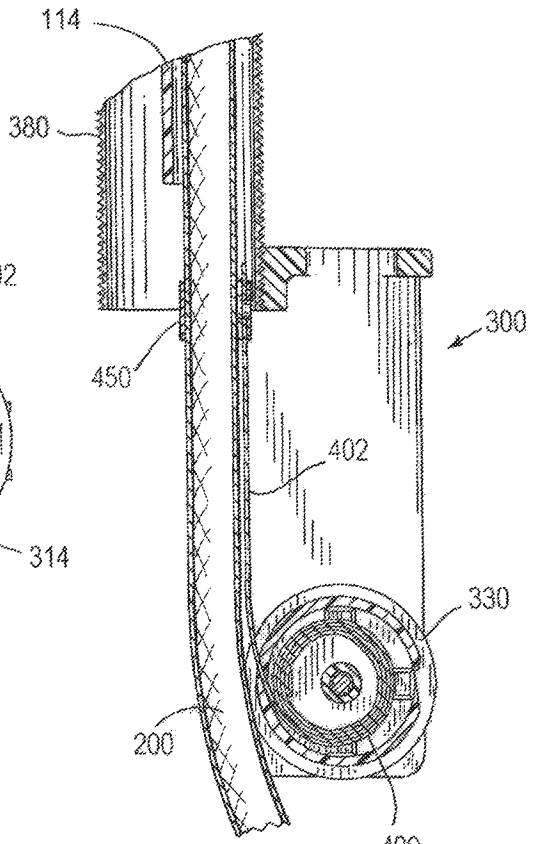
FIG. 9 is a partial cross-sectional view of a pull-out hose partially disposed in the guide tube of a hose retraction system in accordance with an embodiment of the present invention.
Figure 8:
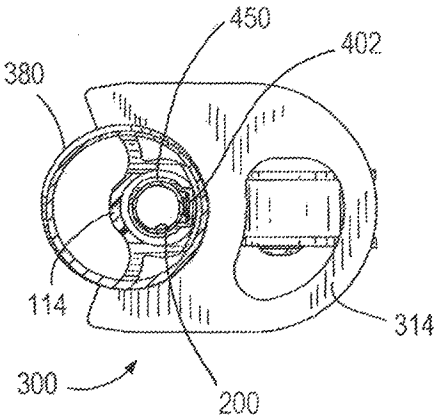
FIGS. 7 and 8 are perspective and top views of a hose retraction system having a guide tube in accordance with an embodiment of the present invention.
Figure 7:
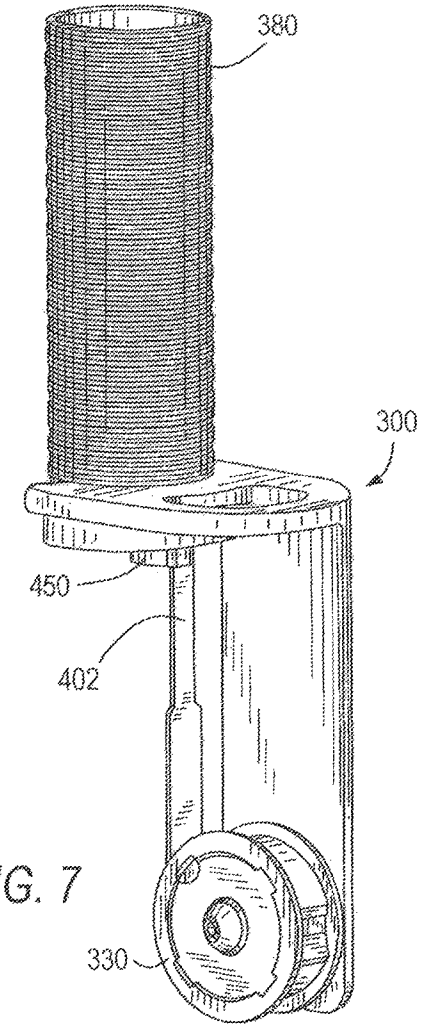

In at least one embodiment, hose retraction system 300 can include a threaded shank or guide tube 380 for guiding, or otherwise accommodating, the hot, cold, and mixed water hoses 151-53 as well as pull-out hose 200 and coil spring 400. FIGS. 7 and 8 are perspective and top views of hose retraction system 300 shown coupled to guide tube 380. FIG. 9 is a partial cross-sectional view of pull-out hose 200 partially disposed in guide tube 380. Guide tube 380 can be composed of any suitable material (e.g., metal, plastic, or the like), and is threaded on its outer surface for coupling to the sink deck. As illustrated in FIGS. 8 and 9, hose divider guide 114, and its various through-holes, can be positioned in guide tube 380. Guide tube 380 is constructed such that its outer circumference conforms to partially-open loop 313 of support bracket 310. The outer surface of guide tube 380 can be threadably coupled to complementary threads 313*a* of partially-open loop 313.

Figure 11:
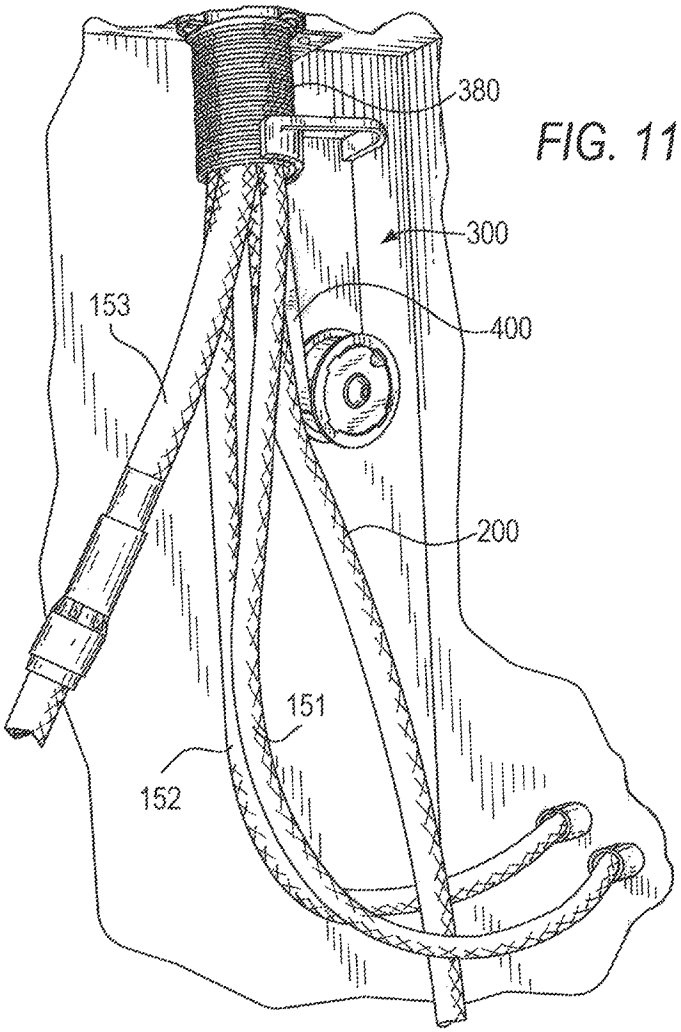
FIGS. 10 and 11 are over deck and under deck views of a pull-out faucet equipped with a hose retraction system, in accordance with an embodiment of the present invention, illustrating the state of the pull-out hose and coil spring when the spray head is in its docked position.
Figure 10:
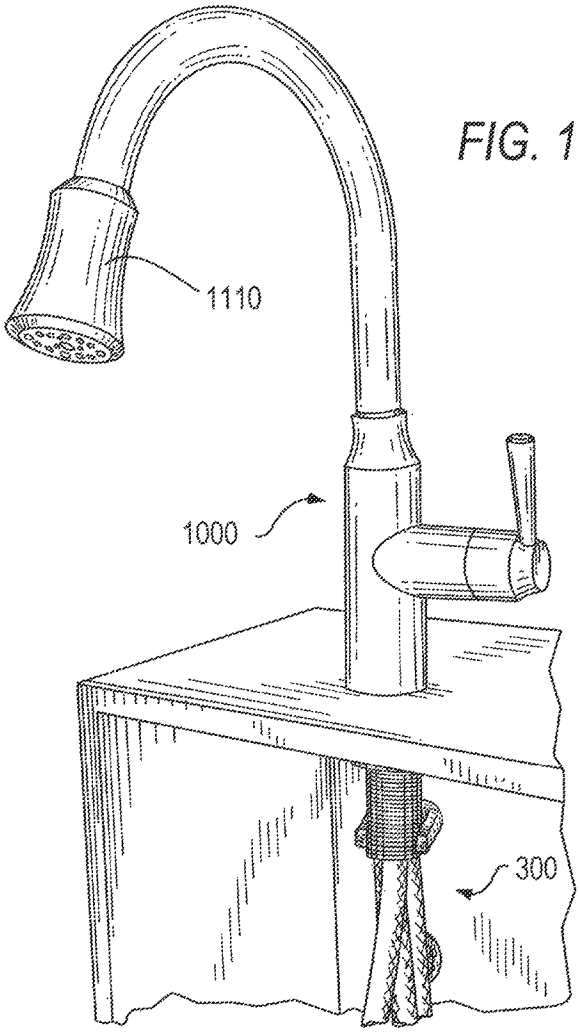
Figure 13:
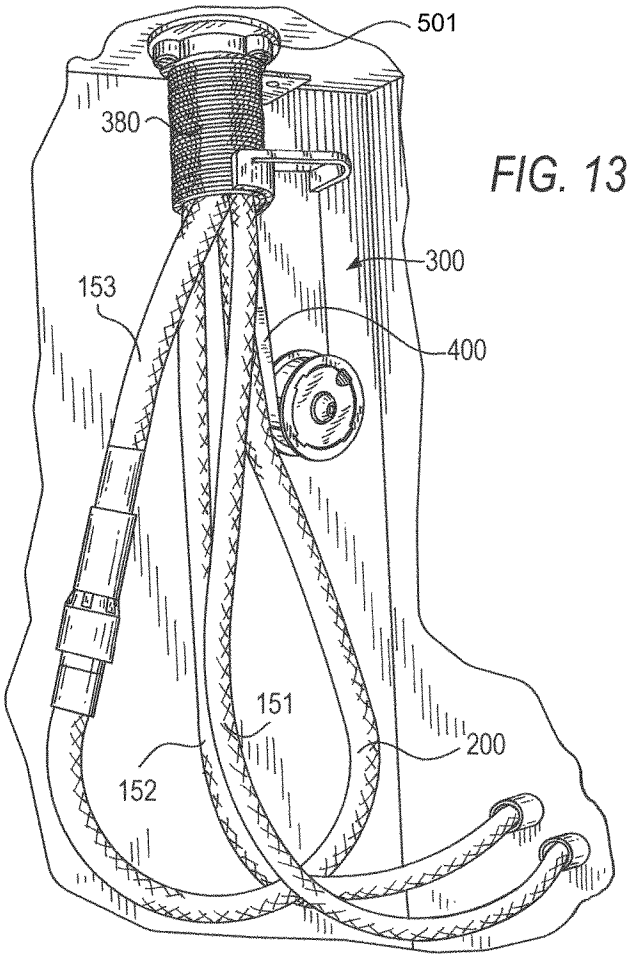
FIGS. 12 and 13 are over deck and under deck views of a pull-out faucet equipped with a hose retraction system, in accordance with an embodiment of the present invention, illustrating the state of the pull-out hose and coil spring when the spray head is in a pulled-out state.
Figure 12:
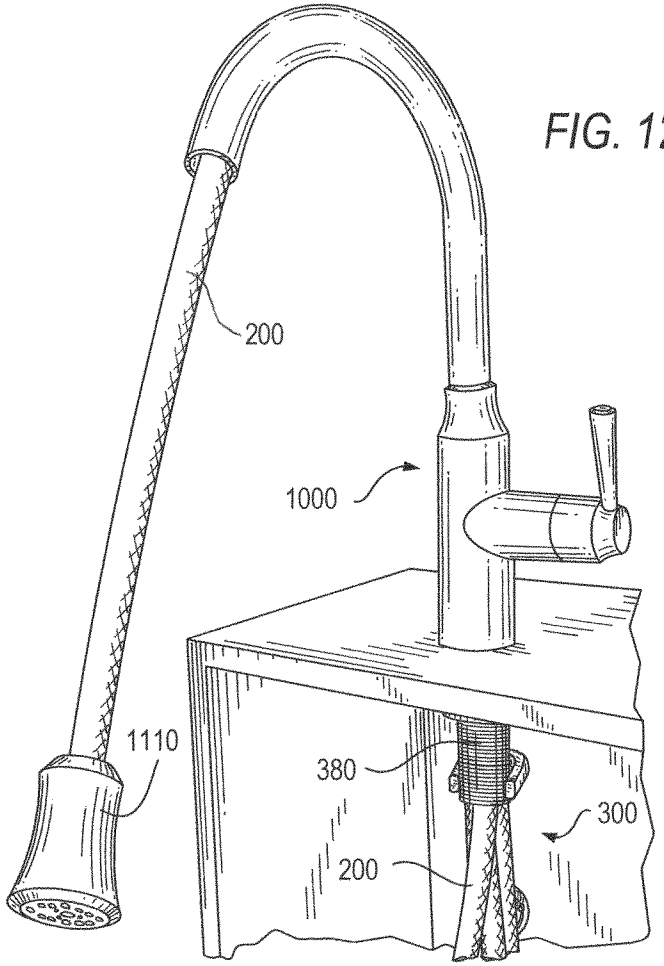
Figure 14:
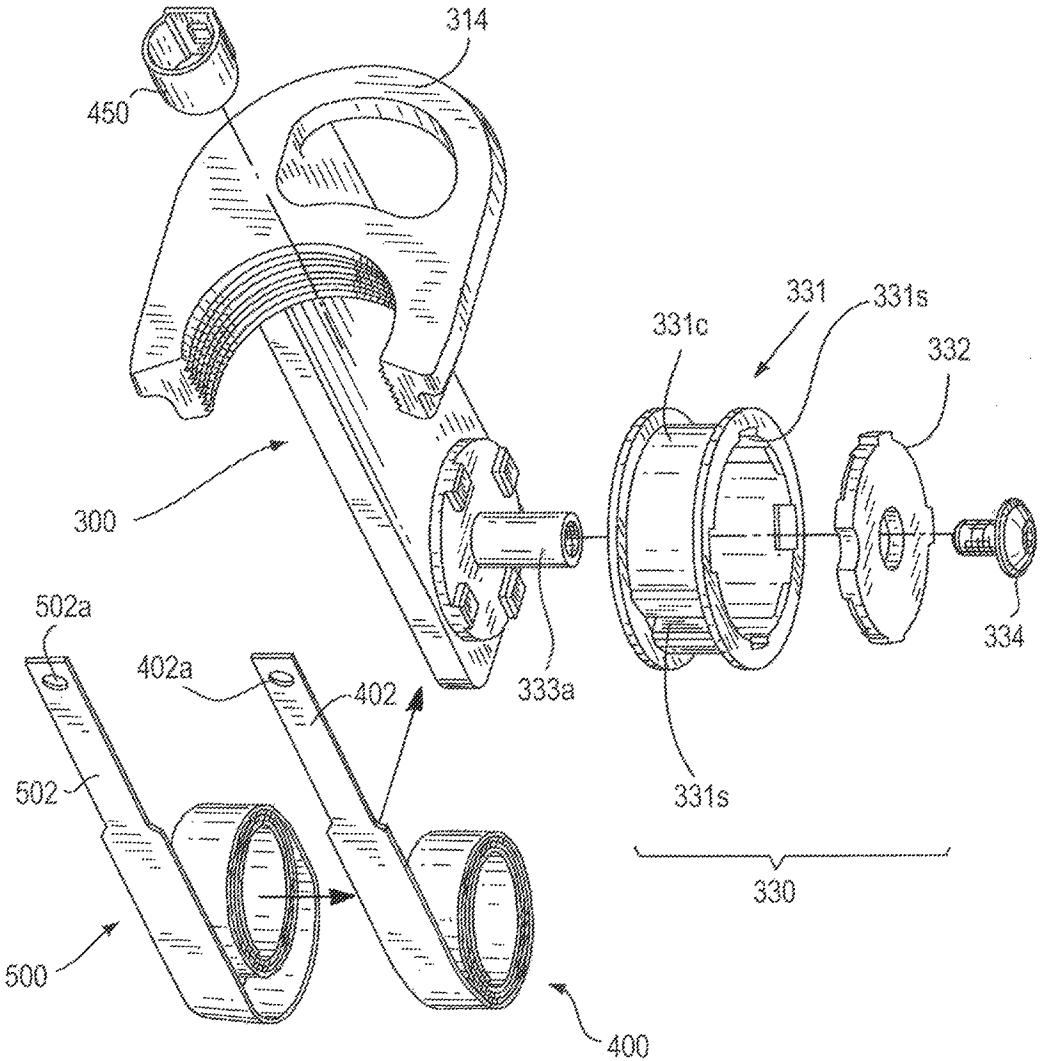
FIGS. 14-17 are exploded and partial perspective views of an alternate hose retraction system, in accordance with an embodiment of the present invention.
Figure 15:
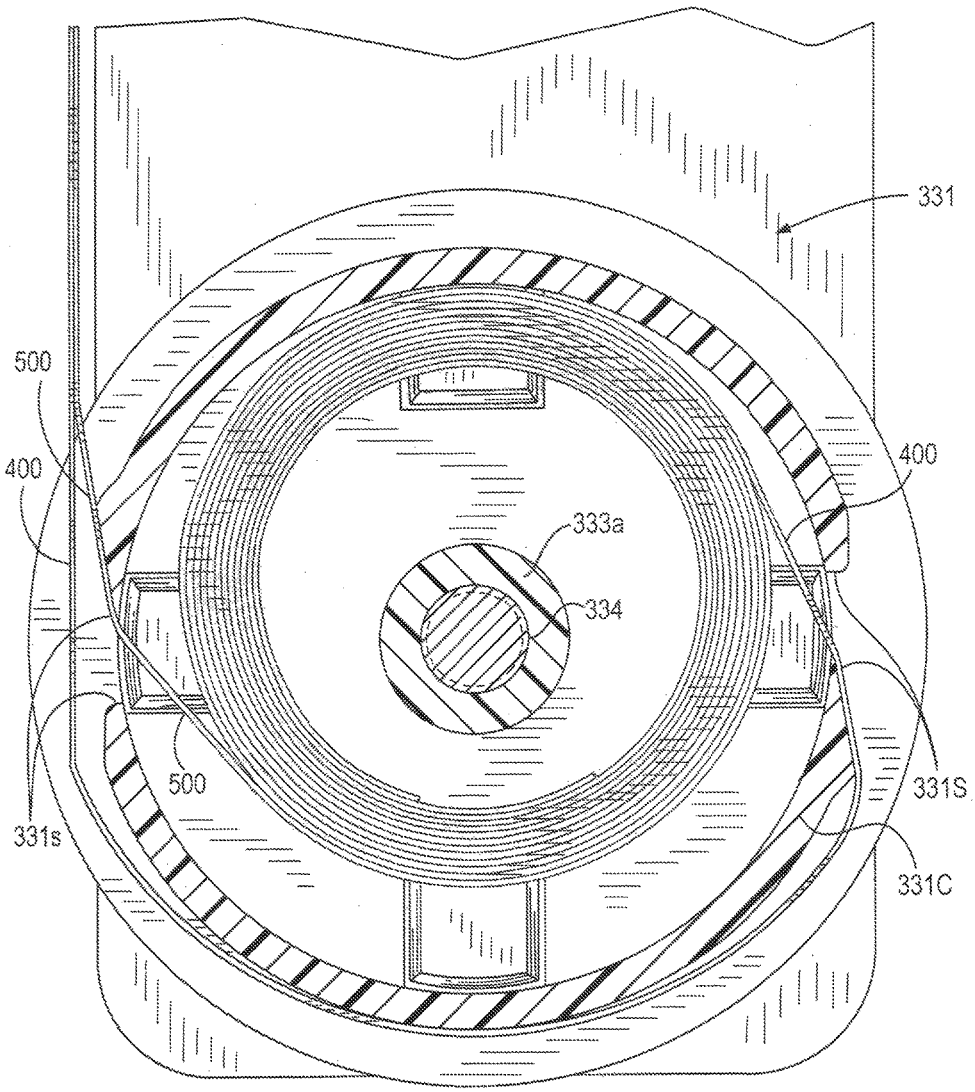
Figure 16:
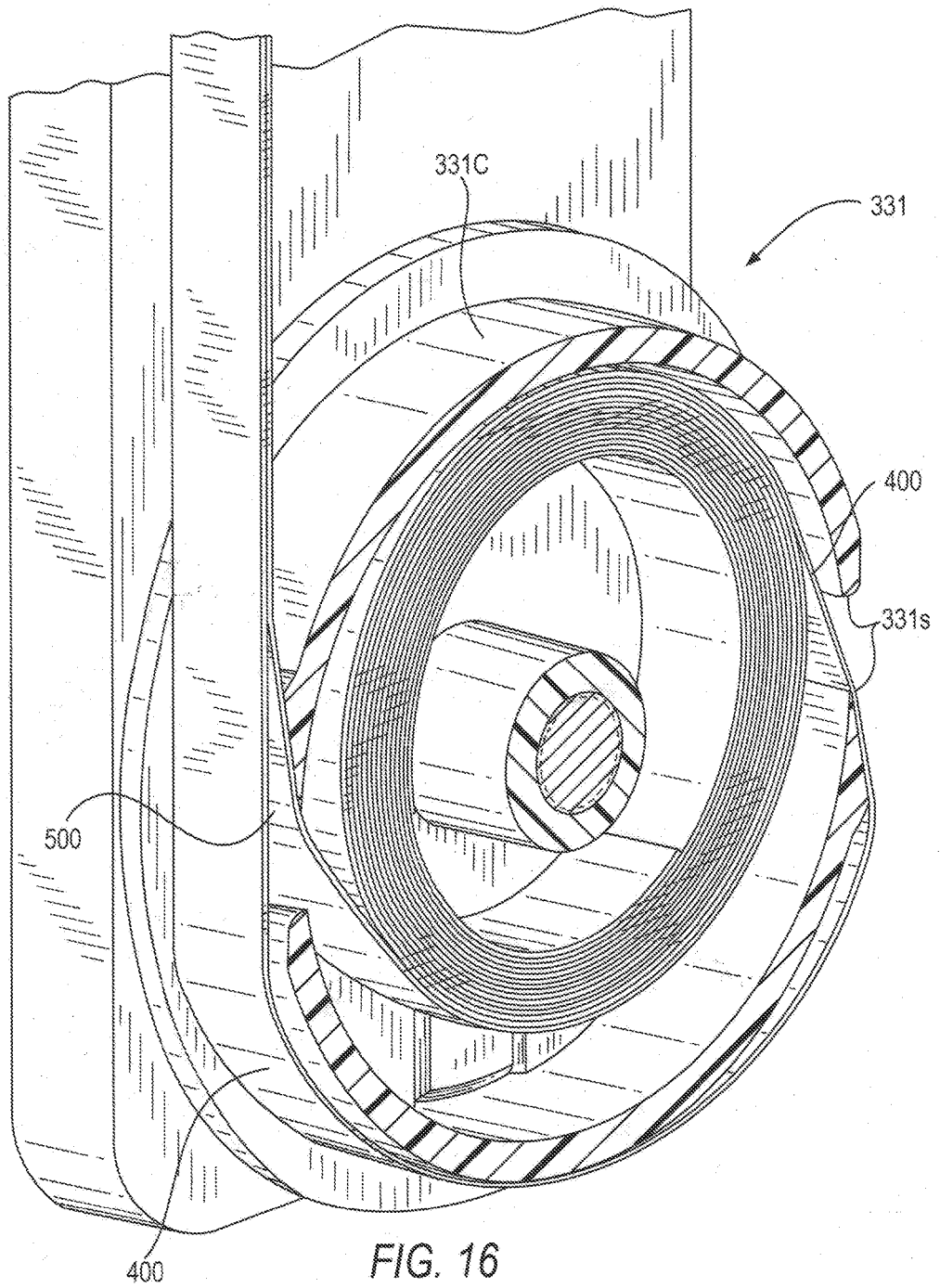
Figure 17:
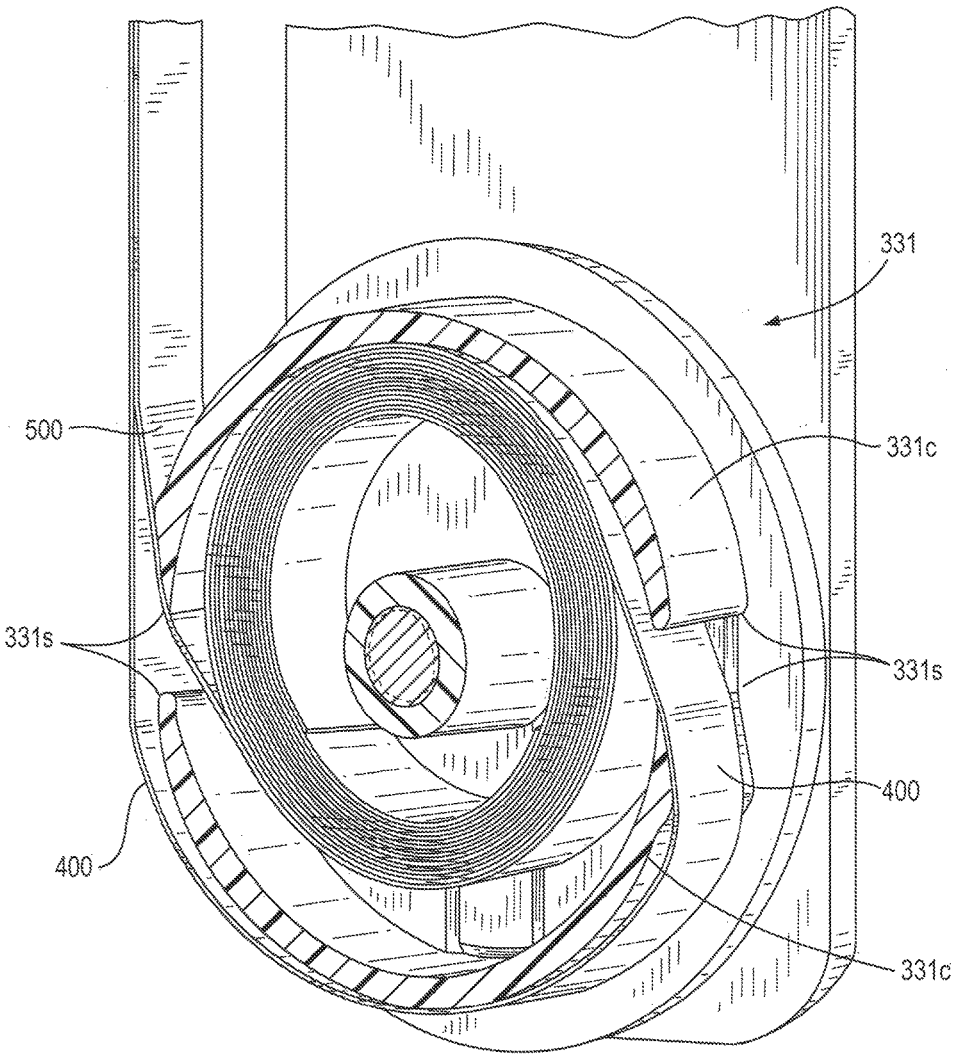

FIGS. 10 and 11 views, above and below the faucet deck, of a pull-out faucet 1000 integrated with hose retraction system 300, illustrating the state of pull-out hose 200 and coil spring 400 when a spray head 1110 of faucet 1000 is in its docked position. FIGS. 12 and 13 are above and below deck views of pull-out faucet 1000 and hose retraction system 300, illustrating the state of pull-out hose 200 and coil spring 400 when spray head 1110 is in a pulled-out state. As shown in FIG. 11, guide tube 380 can be threadably coupled to an undersurface of the deck via a connector 501. The deck can include a hole, defined to conform to an inner circumference of guide tube 380, for routing hot, cold, and mixed water hoses 151-153 as well as pull-out hose 200 and coil spring 400. When spray head 1110 is in its fully docked position, coil spring is in its recoiled state, and pull-out hose 200 is fully retracted. In contrast, when spray head 1110 is in a pulled-out state (FIGS. 12 and 13), hose 200 is extended and coil spring 400 is at least partially uncoiled.A1

Figure 18:
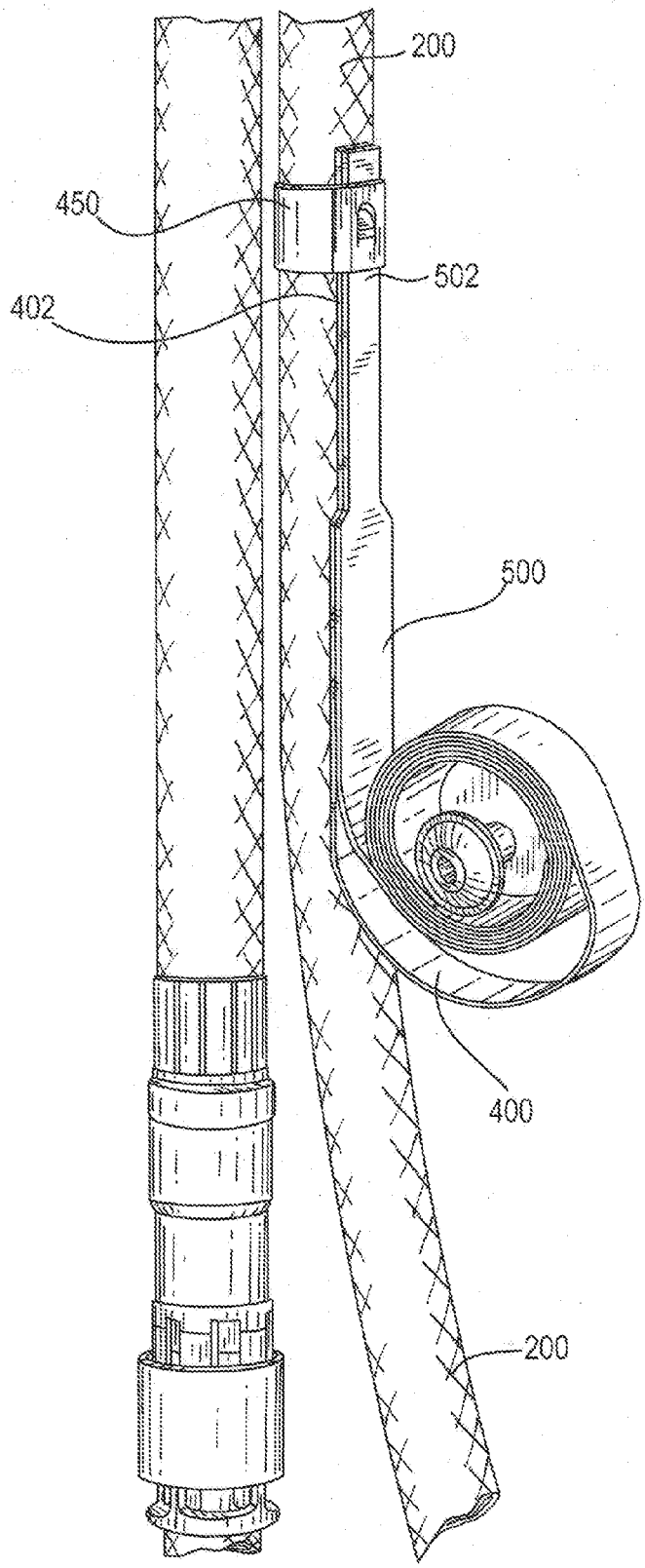
FIG. 18 is an enlarged view of a connection between a pull-out hose and coil springs of the hose retraction system embodiment shown in FIGS. 14-17.
Figure 19:
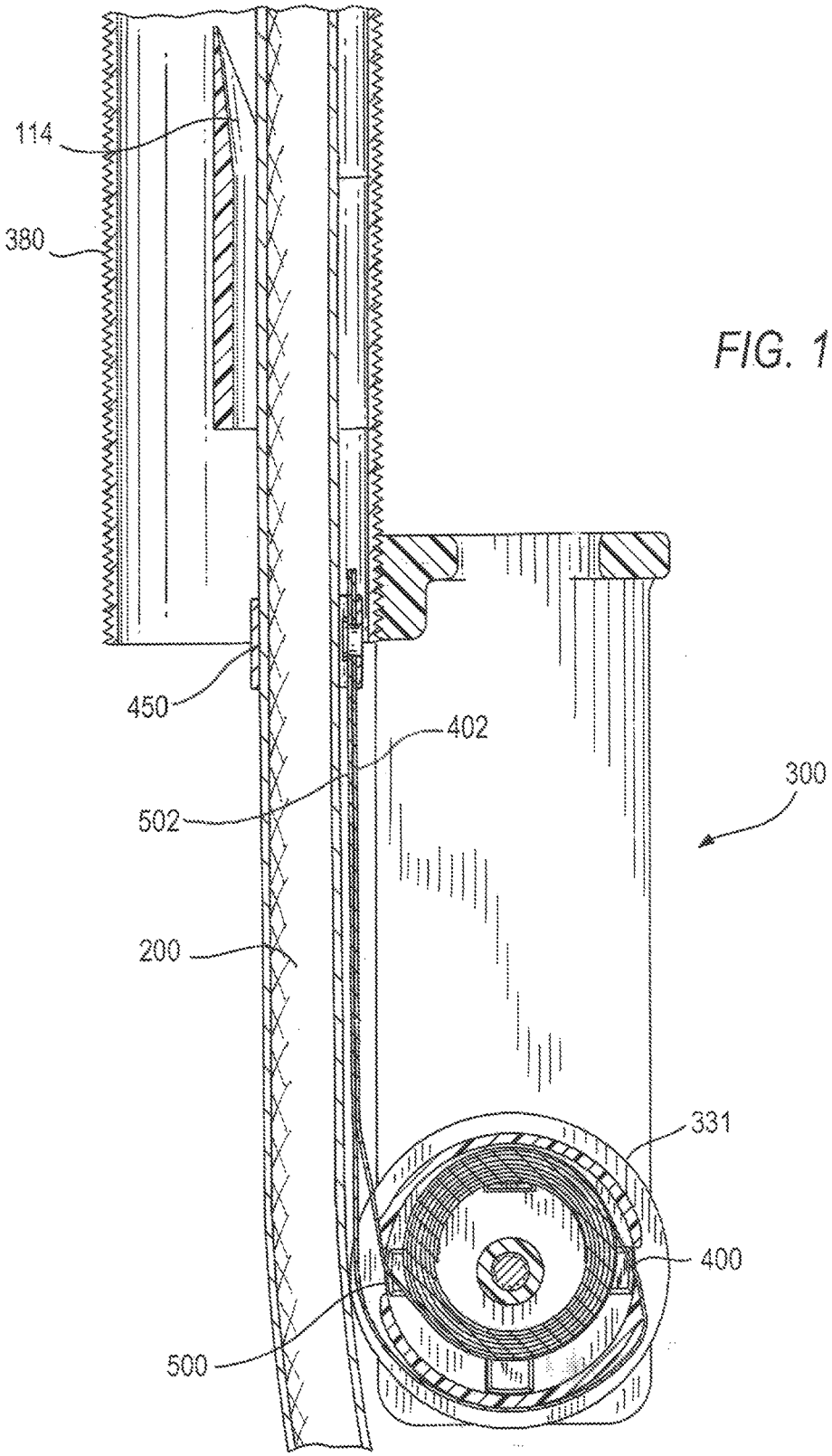
FIG. 19 is a partial cross-sectional view of a pull-out hose partially disposed in a guide tube of the hose retraction system embodiment shown in FIGS. 14-17.

It should be understood that any number of coil springs can be used to retract the pull-out hose. In a preferred embodiment, two coil springs are disposed in a cylindrical housing and coupled to hose 200, providing abundant recoil force for retracting hose 200. FIGS. 14-17 are exploded and partial perspective views of an alternate hose retraction system having two coil springs (i.e., coil spring 400 and a coil spring 500), and a cylindrical container 311 having at least two slots 331*s*. FIG. 18 is an enlarged view of a connection between pull-out hose 200 and coil springs 400 and 500. FIG. 19 is a partial cross-sectional view of pull-out hose 200 partially disposed in a guide tube 380 of the hose retraction system. Coil springs 400 and 500 may be similar to one another, and can be separately inserted into cylindrical container 331 and intertwined with one another via their respective coil spring forces. An end 402 of coil spring 400 can be inserted through one slot 331*s* of core 331*c* and guided along the circumference of core 331*c* toward pull-out hose 200, and an end 502 of the coil spring 500 can be inserted through another slot 331*s* of core 331*c* and directed toward pull-out hose 200. These ends can be coupled to one another and connected to hook member 454 of attachment member 450 via corresponding holes 402*a* and 502*a*. When the ends are pulled along with pull-out hose 200 during hose extension, the intertwined portions of coil springs 400 and 500 are free to rotate or spin in cylindrical container 331.

Accordingly, the retraction system advantageously docks and retracts a pull-out spray head and hose using constant resistance force from coil springs, eliminating the need for conventional weighted objects, and improving user flexibility by allowing users to utilize a longer portion of a pull-out hose.

It will thus be seen that the aspects, features and advantages made apparent from the foregoing are efficiently attained and, since certain changes may be made without departing from the spirit and scope of the invention, it is intended that all matter contained herein shall be interpreted as illustrative and not in a limiting sense.

It is also to be understood that the following claims are intended to cover all of the generic and specific features of the invention herein described and all statements of the scope of the invention that, as a matter of language, might be said to fall therebetween.

What is claimed is:

1. A faucet, comprising:

a spout;

a spray head;

a hose disposed in the spout and fluidly coupled to the spray head; and at least one constant force coil spring having an end portion extendable from a coiled portion of the at least one coil spring, wherein the end portion is coupled to an outer surface of the hose and wherein the spring is configured to provide a recoil force sufficient to retract the hose when the hose is extended from the spout and the end portion is extended from the coiled portion of the at least one coil spring.

2. The faucet of claim 1, wherein the at least one coil spring comprises two coil springs, and wherein each of the two coil springs is at least partially coupled to the hose.

3. The faucet of claim 1, further comprising a cylindrical housing having a container configured to receive the at least one coil spring, and a cap configured to at least partially retain the at least one coil spring in the container.

4. The faucet of claim 3, wherein the container comprises at least one slot configured to slidably pass at least one uncoiled portion of the at least one coil spring.

5. The faucet of claim 1, further comprising:

a shank;

a support bracket coupled to the shank; and a cylindrical housing mounted to the support bracket, the at least one coil spring being disposed within the cylindrical housing.

6. The faucet of claim 5, wherein the support bracket comprises a platform having an opening.

7. The faucet of claim 6, wherein at least a portion of the at least one coil spring passes through the opening when the hose is extended from the spout.

8. The faucet of claim 6, wherein the support bracket comprises a side surface substantially orthogonal to the platform, the side surface having a plate affixed thereto.

9. The faucet of claim 8, wherein the cylindrical housing is mounted to the side surface via the plate.

10. The faucet of claim 6, wherein the opening includes a threaded surface configured to threadably couple to the shank.

11. The faucet of claim 1, further comprising an attachment member coupled to a portion of the hose.

12. The faucet of claim 11, wherein the at least one coil spring comprises a strip having a hole defined therein, the hole being configured to interact with the attachment member and secure the at least one coil spring to the hose.

13. The faucet of claim 1, wherein the width of the at least one coil spring is less than the internal diameter of the spout, thereby allowing at least a portion of the at least one coil spring to enter the spout when the hose is extended.

14. The faucet of claim 1, wherein the at least one coil spring is at least partially composed of metal.

15. The faucet of claim 1, wherein the faucet is one of a pull-out and a pull-down faucet.

16. A hose retraction system for a pull-out faucet, the pull-out faucet having a shank, a spout, a spray head, and a hose disposed in the spout and fluidly coupled to the spray head, the system comprising:

a support bracket configured to couple to the shank;

a housing mountable to the support bracket; and at least one constant force coil spring disposable in the housing and having an end portion extendable from a coiled portion of the at least one coil spring, wherein the end portion is configured to at least partially couple to the outer surface of the hose and wherein the spring is configured to provide a recoil force sufficient to retract the hose when the hose is extended from the spout and the end portion is extended from the coiled portion of the at least one coil spring.

17. The system of claim 16, wherein the support bracket is configured to threadably couple to the shank.

18. The system of claim 16, wherein the at least one coil spring comprises two coil springs, and wherein each of the two coil springs is configured to at least partially couple to the hose.

19. The system of claim 16, wherein the housing comprises a container configured to receive the at least one coil spring, and a cap configured to at least partially retain the at least one coil spring in the container.

20. The system of claim 19, wherein the container comprises at least one slot configured to slidably pass uncoiled portions of the at least one coil spring.

* * * * *